US005521693A

United States Patent [19]

Kojima et al.

[11] Patent Number: 5,521,693

[45] Date of Patent: May 28, 1996

[54] IMAGE FORMING APPARATUS AND PROCESS CARTRIDGE DETACHABLY MOUNTABLE TO SAME

[75] Inventors: Hisayoshi Kojima, Yokohama; Masaki Ohtake, Kawasaki; Toshiki Nagase, Hohya; Mitsugu Inomata, Kawasaki, all of Japan

[73] Assignee: Canon Kabushiki Kaisha, Tokyo, Japan

[21] Appl. No.: 403,119

[22] Filed: Mar. 13, 1995

Related U.S. Application Data

[63] Continuation of Ser. No. 882,568, May 13, 1992, abandoned.

[30] Foreign Application Priority Data

May 14, 1991 [JP] Japan ..... 3-137098
May 14, 1991 [JP] Japan ..... 3-137099

[51] Int. Cl.[6] ..... G03G 15/01

[52] U.S. Cl. ..... 355/326 R; 355/210; 355/246

[58] Field of Search ..... 355/200, 210, 355/211, 212, 213, 260, 326 R, 327, 328, 246, 208; 346/157; 347/115

[56] References Cited

U.S. PATENT DOCUMENTS 4,835,569 5/1989 Oka ..... 355/274
4,924,806 5/1990 Mizuno et al. ..... 355/326 R
5,030,988 7/1991 Haneda et al. ..... 355/200
5,235,383 8/1993 Tada et al. ..... 355/210

FOREIGN PATENT DOCUMENTS 2-144569 6/1990 Japan ..... 355/210

OTHER PUBLICATIONS

Bogart, Jr, *Electronic Devices and Circuits,* 1986, pp. 121–122 and 308–309.

*Primary Examiner*—John E. Barlow, Jr.
*Attorney, Agent, or Firm*—Fitzpatrick, Cella, Harper & Scinto

[57] ABSTRACT

A process cartridge detachably mountable to an image forming apparatus includes an image bearing member; a plurality of developing devices for supplying a developer to the image bearing member, the developing devices each having a first electric contact; a second electric contact for establishing electric connection with the apparatus when the cartridge is mounted in the image forming apparatus; and a selector for selecting one of the first electric contacts, the selector being effective to electrically connecting the selected first electric contact and the second contact.

32 Claims, 11 Drawing Sheets

IMAGE FORMING APPARATUS AND PROCESS CARTRIDGE DETACHABLY MOUNTABLE TO SAME

FIELD OF THE INVENTION AND RELATED ART

This application is a continuation of application Ser. No. 07/882,568 filed May 13, 1992, now abandoned.

The present invention relates to an image forming apparatus such as a copying machine or a printer, and more particularly to an image forming apparatus capable of forming different color toner images on the same recording material, and a process cartridge detachably mountable to the image forming apparatus.

A process cartridge is widely used in a monochromatic image forming apparatus because it allows easy maintenance. The process cartridge contains a photosensitive member and a developing device or the like, and is detachably mountable to the main assembly of the image forming apparatus.

In the case of a full-color image forming apparatus in which different color toner images are formed on the same recording material, it has recently been proposed from the standpoint of the easy maintenance that a plurality of developing devices and a photosensitive member is contained in a cartridge.

When an image is formed in a color image forming apparatus, a selecting operation is performed to select a desired color developer, and a developing bias voltage is supplied to the selected developer. Therefore, in the case of the cartridge containing a plurality of developing devices, each of the developing devices is provided with an electric contact engageable to an electric contact of the main assembly in order to supply the developing bias voltage thereto. As will be understood, the number of electric contacts is larger in the case of the cartridge containing at least the photosensitive member and a plurality of developing devices than in the case having a single developing device. Therefore, when the cartridge is mounted to the main assembly, it is difficult to assuredly establish electric contacts between the contacts of the cartridge and the corresponding contacts of the main assembly. In addition, the wiring in the cartridge is complicated.

SUMMARY OF THE INVENTION

Accordingly, it is a principal object of the present invention to provide an image forming apparatus and a process cartridge detachably mountable to the same, in which the number of electric contacts of the process cartridge is reduced.

It is another object of the present invention to provide an image forming apparatus and a process cartridge detachably mountable to the same, in which the mounting and demounting of the process cartridge are made easier.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
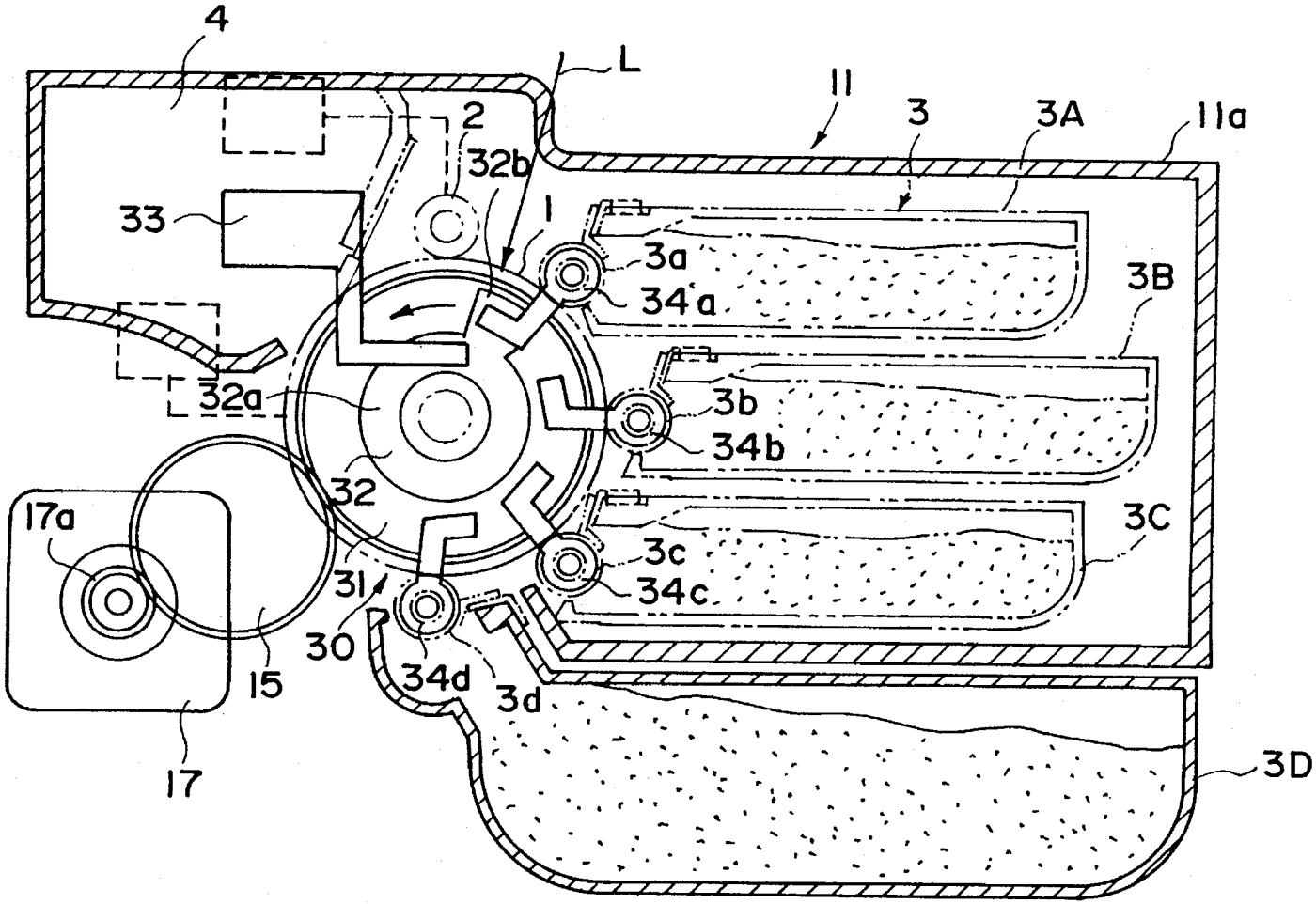
FIG. 1 is a side view of contact selecting means in an apparatus according to a first embodiment of the present invention.
Figure 2:
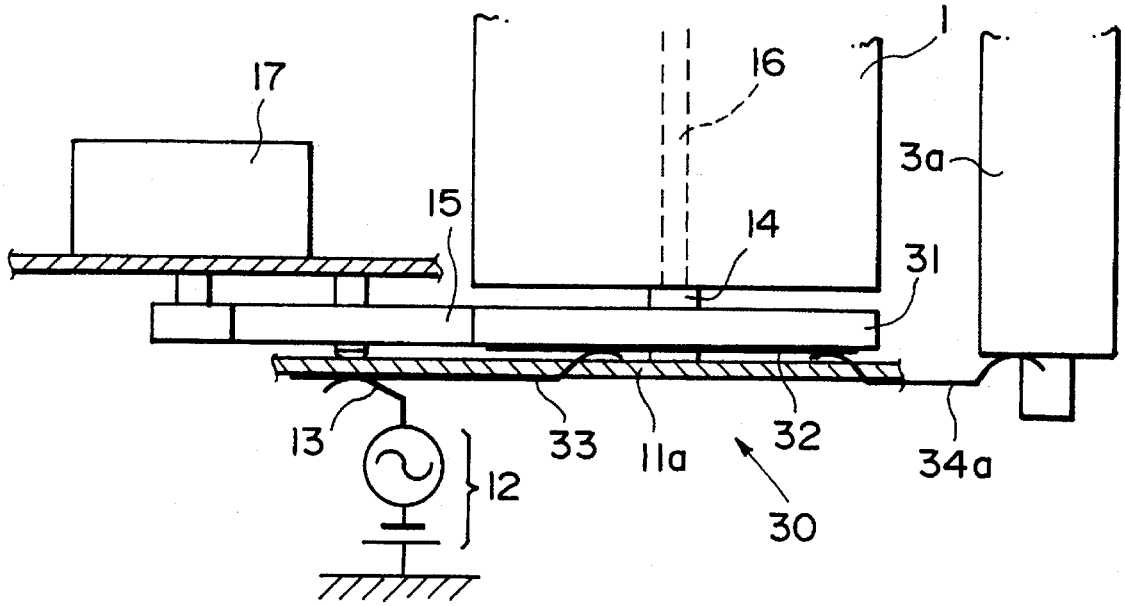
FIG. 2 is a top plan view of contact selecting means used in the apparatus of FIG. 1.
Figure 3:
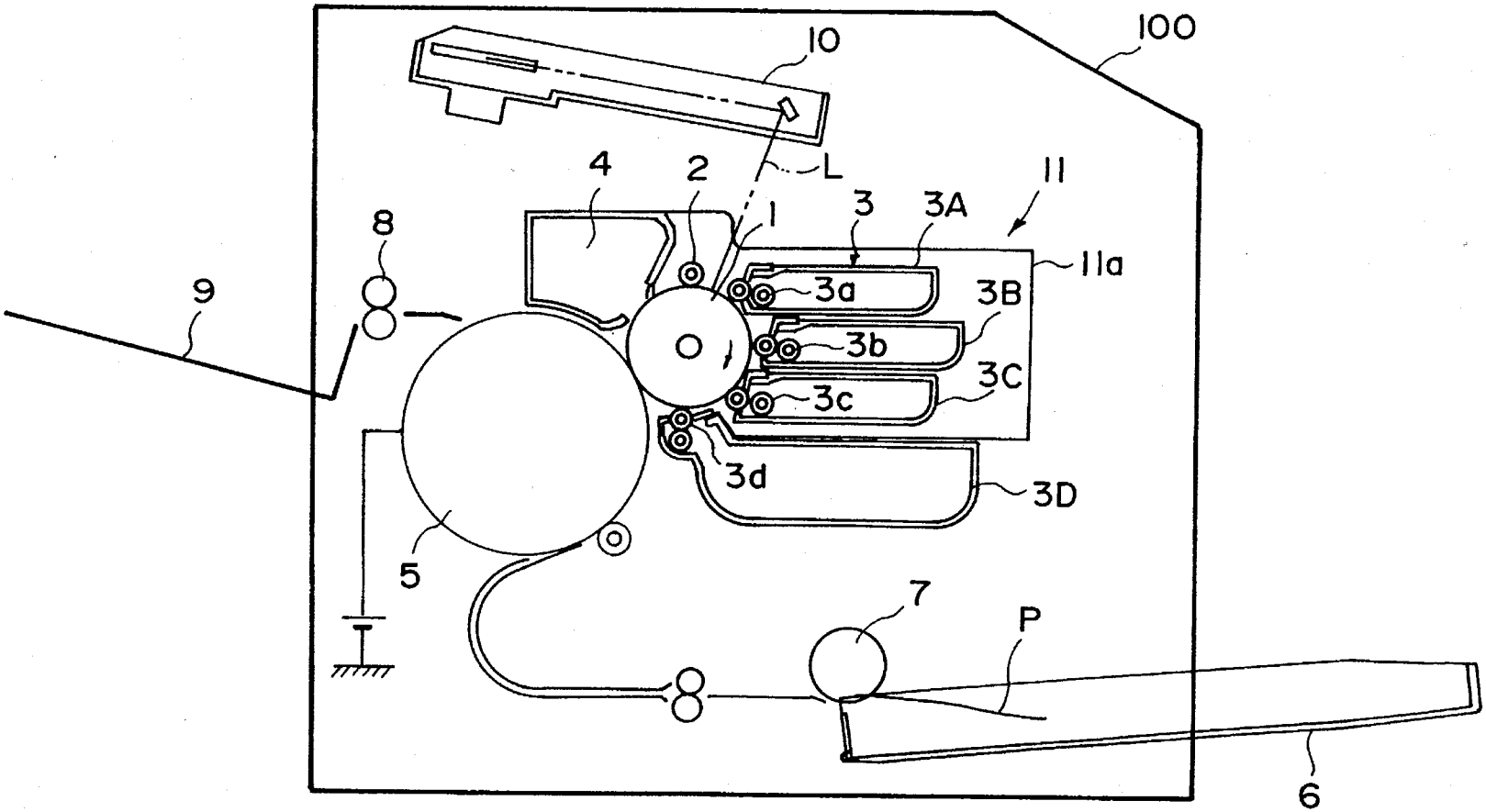
FIG. 3 is a side view of an example of an image forming apparatus according to an embodiment of the present invention.

Referring to FIGS. 1–3, there is shown an apparatus according to a first embodiment of the present invention. FIG. 3 is a sectional view of a color image forming apparatus capable of forming a multi-color or full-color images. In this Figure, a process cartridge 11 is shown as having been mounted in a main assembly 100 of the image forming apparatus. It comprises an image bearing member in the form of a photosensitive drum rotatable in a predetermined direction. Around the photosensitive drum 1, there are provided a charging roller 2 for uniformly charging the photosensitive drum, four developing devices 3 (yellow, magenta, cyan, and black developing devices 3A, 3B, 3C, and 3D containing yellow, magenta, cyan, and black developers, respectively), a cleaning device 4 and a transfer drum 5. In this embodiment, the black developing device 3D is a developing unit detachably mountable to the main assembly separately from the process cartridge 11. Adjacent the sheet feeding side of the transfer drum 5, there are a sheet feeding cassette 6, and a pick-up roller 7 or the like. Adjacent the sheet discharging side, there are a fixing device 8 and a sheet discharging tray 9. Above the photosensitive drum 1, there is a scanning optical system 10 for emitting light image L for image information of each of yellow, magenta, cyan and black colors.

Each of the developing devices has a developing sleeve 3*a*, 3*b*, 3*c*, or 3*d* functioning as a developer carrying member for carrying the toner on its outer periphery and supplying the toner to the photosensitive drum 1. When an electrostatic latent image formed on the photosensitive drum 1 comes to face the developing sleeve, a developing bias is applied to the developing sleeve, by which the toner on the developing sleeve is transferred onto the photosensitive drum 1 to develop the electrostatic latent image into a visualized toner image on the photosensitive drum 1.

The transfer drum 5 carries on its outer periphery a recording material P and rotates in synchronism with the photosensitive drum 1. Onto the recording material P, respective color toner images are transferred superposedly. The transfer drum 5 is supplied from a voltage source (not shown) of the main assembly with a voltage having a polarity opposite to the charging polarity of the photosensitive drum 1, by which the toner images are transferred from the photosensitive drum 1 onto the recording material P. The recording material P is retained on the transfer drum 5 by electrostatic attraction or vacuum attraction or the like. In addition, in order to correctly position the leading edge of the recording material P, a gripper or the like may be used.

The photosensitive drum 1 is uniformly charged by a charging roller 2 and is exposed to the image light L of yellow image through an optical scanning system 10. When an electrostatic latent image is formed on the photosensitive drum 1, the electrostatic latent image is carried on the photosensitive drum 1 to the yellow developing device 3A, which supplies the toner to the latent image, thus developing it as a toner image. Together with the rotation of the photosensitive drum 1, the toner image is transferred onto a transfer material P which is carried on an outer periphery of the transfer drum 5 which rotates in synchronism with the photosensitive drum 1.

After the completion of the image transfer operation, the photosensitive drum 1 is cleaned by the cleaning device 4 so that the residual toner is removed therefrom. Thereafter, it is uniformly charged again by the charging roller 1 and is exposed to the image light L of the magenta image through the optical scanning device 10, so that an electrostatic latent image is formed on the photosensitive drum. The electrostatic latent image is visualized into a toner image by the magenta developing device 3B. The toner image is then transferred onto the same transfer material P superposedly, the transfer material P being still carried on the transfer drum 5 which is rotated in timed relation with the toner image. In a similar manner, the toner images are formed for the cyan and black component image lights L are formed on the photosensitive drum 1 by the chain and black developing devices 3C and 3D, respectively, and the toner images are sequentially and superposedly transferred onto the transfer material P.

The transfer material P in the sheet feeding cassette 6 is supplied to the transfer drum 5 by way of sheet feeding roller 7 or the like, and is positioned on the outer periphery of the transfer drum 5. With the rotation of the transfer drum 5, the toner images are overlaid on the transfer material P. After the completion of the transfer operation, the transfer material P is conveyed away from the transfer drum 5 to the fixing device 8, where the toner images are heated and pressed to be fused, and mixed and fixed into a permanent image. Thereafter, it is discharged onto a sheet discharge tray 9.

In this embodiment, the photosensitive drum 1, the charging roller 2, the yellow, magenta, and cyan developing devices 3A, 3B, and 3C and the cleaning device 4, are integrally contained in a cartridge body 11*a* to constitute a process cartridge 11. It is easily mounted to and demounted from the main assembly 100 of the image forming apparatus. When the toner particles in the developing device 3A, 3B, or 3C are used up or when the cleaning device 4 becomes filled with residual toner particles, the process cartridge as a whole is exchanged. With this structure, the toner supply to the developing device 3 and the exchange of elements are made easier. Here, the process cartridge contains at least an image bearing member and a plurality of developing means.

During the developing operation, the developing sleeve of the developing device is to be supplied with a developing bias voltage from the main assembly 100. Then, when the cartridge contains plural developing devices, electric contacts are required for supplying the bias voltages to the respective developing devices.

However, in this embodiment, only one electric contact is provided for connection between the main assembly and the respective developing devices. To accomplish this, the cartridge in this embodiment is provided with a power supply contact switching mechanism 30 (selecting means) for selecting one of contacts (first contacts) of the plural developing devices, so that a contact of the main assembly (a third contact) is electrically connected with the selected one of the first contacts, when the cartridge is in place in the main assembly.

As shown in FIGS. 1 and 2, the switching mechanism 30 is disposed adjacent a longitudinal end of the photosensitive drum 1 of the cartridge body 11*a*. The switching mechanism 30 includes a switching gear 31, a switching contact 32, a cartridge contact 33 and developing device contacts 34*a*, 34*b*, 34*c*, and 34*d*. The switching gear 31 is independently rotatable from rotation of the photosensitive drum 1, about an axis 16, and is made of electrically non-conductive material. The switching gear 31 is supported on a shaft 14. The switching contact member 32 is bonded on or embedded in a cartridge main body side of the switching gear 31 and includes an electrically conductive ring 32*a* and a projection 32*b* extending from outer periphery of the conductive portion 32*a*. The cartridge contact 33 is mounted on the main body of the cartridge 11*a*. An end thereof is contacted to the conductive portion 32*a* of the switching contact 32, and the other end thereof is electrically connected with a main assembly contact 13 of the main assembly 100 connected in turn to the bias source 12. The developing device contacts 34*a*, 34*b*, 34*c*, and 34*d* are mounted to the cartridge body 11*a* for the respective developing devices 3. One side ends thereof are contacted to the respective developing sleeves 3*a*, 3*b*, 3*c*, and 3*d* of the developing devices. The other side ends are contacted to circumferentially outer portions of the side surface of the switching gear 31. In this embodiment, the black developing device (developing unit) 3D has the developing device contact 34*d* mounted to the developing sleeve 3*d*.

The main assembly 100 is provided with a switching motor 17, a driving gear 17*a*, and an idler gear 15 in meshing engagement with the switching gear 31. The switching gear 31 is rotated through a predetermined rotational angle by rotation of the switching motor 17.

When the process cartridge is mounted in the main assembly 100, the cartridge contact 33 and the main assembly contact 13 connected to the bias voltage source 12 are electrically connected, and in addition, the switching gear 31 is brought into meshing engagement with the idler gear 15. Furthermore, the developing device contact 34*d* of the black developing device 3*d* is contacted to the side surface of the switching gear 31. When the developing operation is performed by the yellow developing device 3A, for example, the switching gear 31 is rotated through a predetermined angle through the idler gear 15 by the switching motor 17, so that the projected portion 32*b* of the switching contact 32 is connected with the developing device contact 34*a* of the yellow developing device 3*a*. In this case, the projected portion 32*a* of the switching contact 32 continues the contact with the cartridge contact 33. When the developing bias voltage is applied from the bias voltage source 12, the voltage is applied to the developing sleeve 3*a* of the yellow developing device 3A through the main assembly contact 13, the cartridge contact 33, the switching contact 32 and the developing device contact 34*a*, thus permitting developing action of the yellow developing device 3A.

When the toner is to be supplied from the magenta developing device 3B to the photosensitive drum 1, the switching motor 17 is energized in response to a signal from a control device (not shown), so that the switching gear 31 rotates through a predetermined angular distance, until the projected portion 32*b* is contacted to the developing device contact 34*b* engaged with the developing sleeve 3*b* of the magenta developing device 3B. By doing so, the bias voltage is supplied to the developing sleeve 3*b* from the voltage source 12 through the third contact 13 of the main assembly, and the second contact 33 of the cartridge.

In a similar manner, the developing bias voltage is supplied for the other colors.

As described in the foregoing, the electric connection between the main assembly and the plural developing devices in the cartridge, is established at one position, and therefore, the inconvenience such as the improper contact between contacts, is reduced. The reduction of the number of contact points, the mounting and demounting action of the cartridge is made easier.

Figure 4:
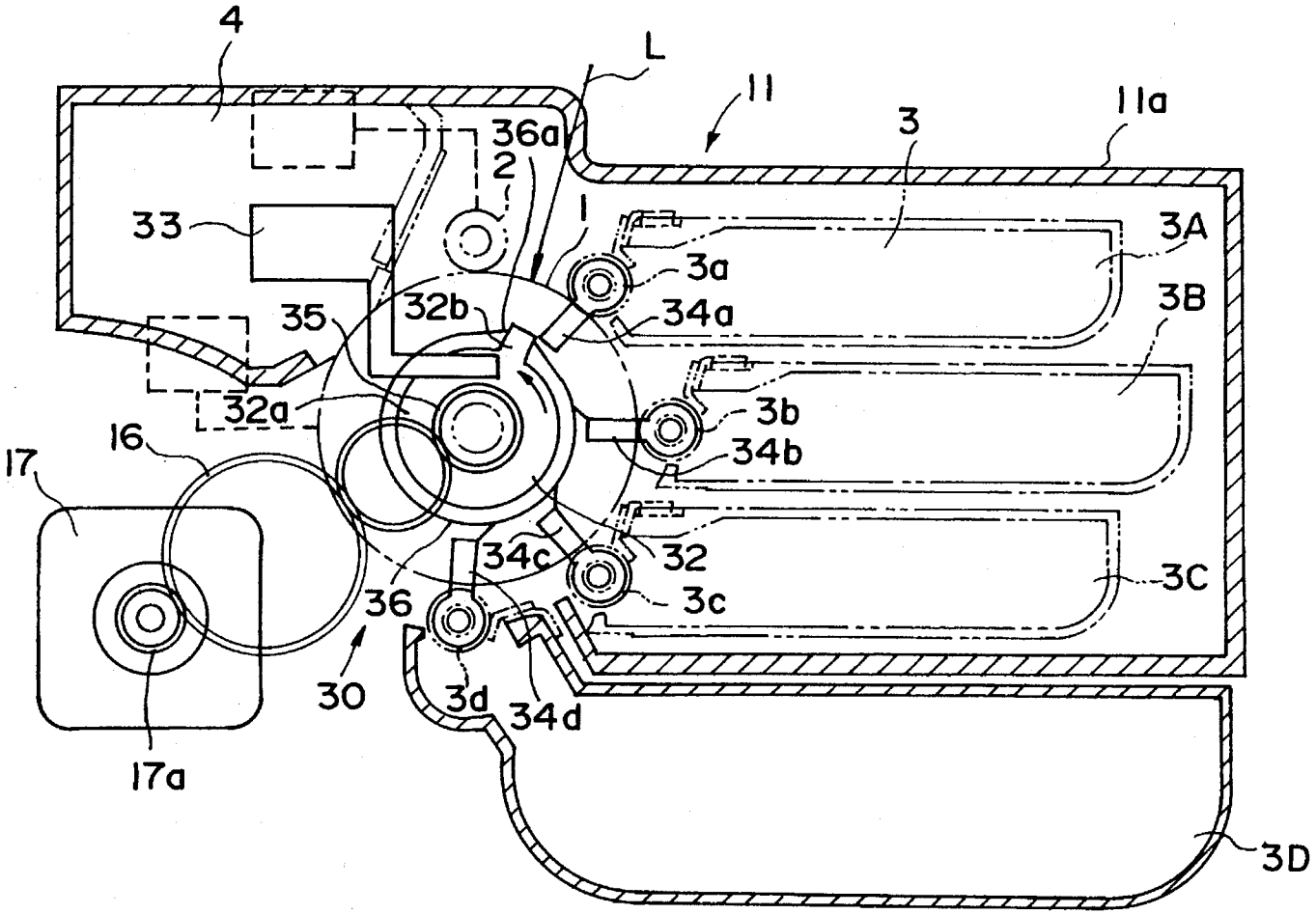
FIG. 4 is a side view of contact selecting means according to a second embodiment of the present invention.

Referring to FIG. 4, the second embodiment of the present invention will be described. In this Figure, the same reference numerals as in the first embodiment are assigned to the element having the corresponding functions, and a detailed description thereof are omitted for simplicity.

In this embodiment, the power supply contact switching mechanism 30 comprises a cam gear 35, a switching contact 32 and developing device contact members 34*a*, 34*b*, 34*c*, and 34*d*. The cam gear 35 supports a cam member 36 and is rotatably supported on a shaft 14 on the cartridge body 11*a*. A switching contact 32 is mounted on a side surface of the cam member 36 and includes an electrically conductive ring portion 32*a* and a projection 32*b* extended from the conductive portion 32*a* to a circumferentially outer end 36*a* of the cam member 36. The switching mechanism 30 also comprises a cartridge contact 33. The rotating force from the switching motor 17 of the main assembly 100 is transmitted to the cam gear 35 from the motor gear 17*a* and through first and second idler gears 16 and 18.

When the process cartridge 11 is mounted in the main assembly 100, the electric connection is established between the cartridge contact member 33 and the main assembly contact 13 or the like, and the operative meshing engagement is established between the second idler gear 18 and the cam gear 35. In order to supply the developing bias voltage to a selected one of the developing devices during the image forming operation, the switching motor 17 rotates the cam gear 35, and therefore, the cam member 36 so that the electric connection is established between the developing device contact of the selected developing device and the projected portion 32*b* of the switching contact member 32. By applying a predetermined bias voltage from the bias voltage source 12 of the main assembly 100, the developing bias can be applied to the selected developing device, as in the same way and with the same effects as in the first embodiment.

Figure 5:
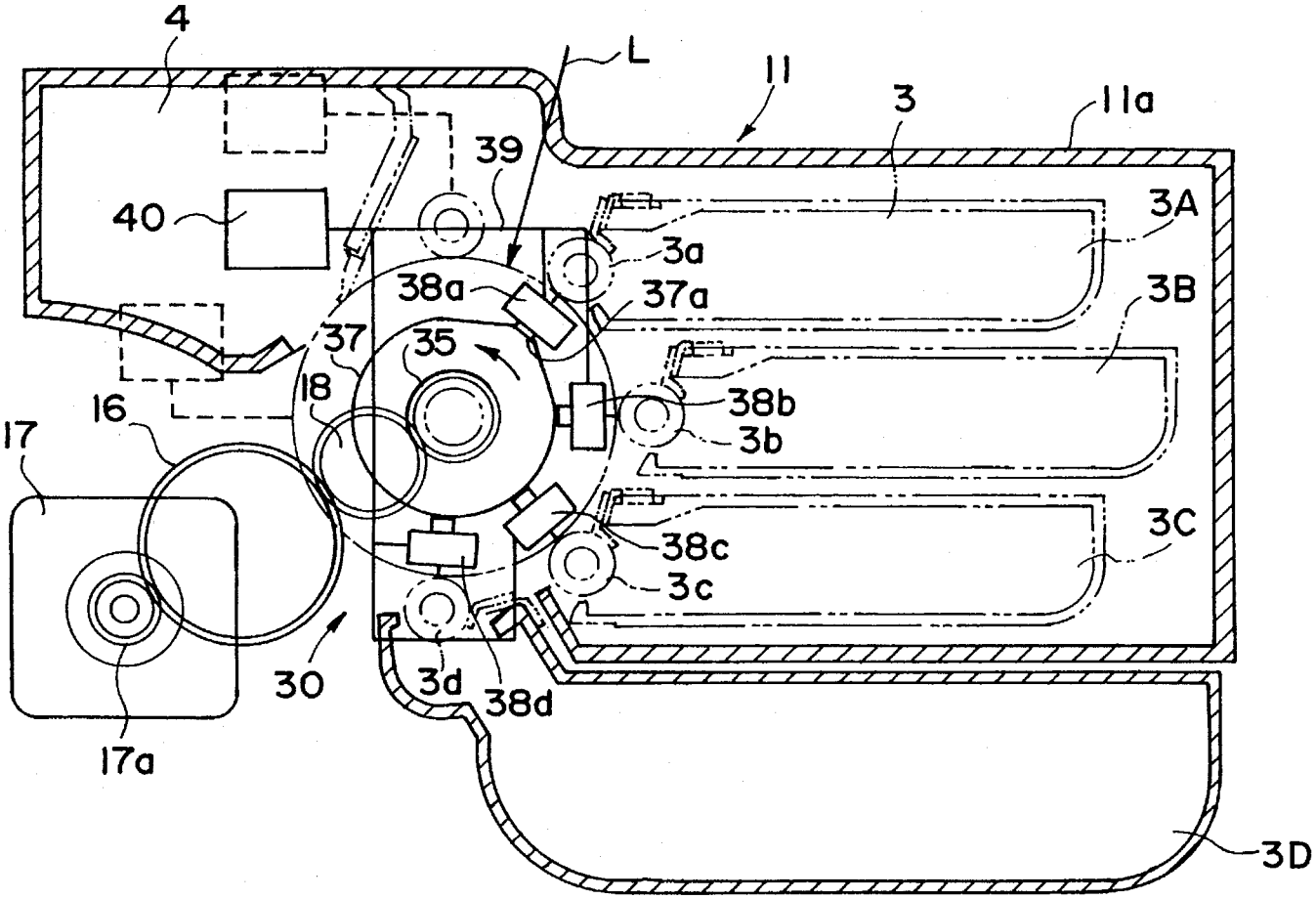
FIG. 5 is a side view of contact selecting means according to a third embodiment of the present invention.

Referring to FIG. 5, a third embodiment of the present invention will be described. In this Figure, the same reference numerals as in the first and second embodiments are assigned to the elements having the corresponding functions, and a detailed description thereof is omitted for simplicity.

In this embodiment, the power supply contact switching mechanism 30 comprises a cam gear 35, developing device switches 38*a*, 38*b*, 38*c*, and 38*d* and a cartridge contact 40. The cam gear 35 supports a cam member 37 and is rotatably supported on a shaft 14 of the cartridge body 11*a*. The developing device switches 38*a*, 38*b*, 38*c*, and 38*d* are actuated or deactuated by the projection 37*a* of the cam member 37. The number of developing switches is the same as the number of the developing devices 3. The cartridge contact 40 is electrically connected with the developing switches through the wiring 39. The developing switches 38*a*, 38*b*, 38*c* and 38*d* are electrically connected with the developing sleeves of the respective developing devices. When one of the developing device switches 38*a*, 38*b*, 38*c* and 38*d* is actuated, the cartridge contact 33 is electrically connected with the developing sleeve through that one of the developing switches. The cam gear 35 is rotated through the switching motor 17, the first and second idler gears 16 and 18 or others.

In this embodiment, the same effects as in the first and second embodiments can be provided by the power supply contact switching mechanism 30. Particularly in this embodiment, there is no such sliding contacts as between the switching contact 32 and the developing device contact 34 and the cartridge contact 33 as in the first and second embodiments. Therefore, the improper contact attributable to the wearing of the contacts can be avoided.

Figure 6:
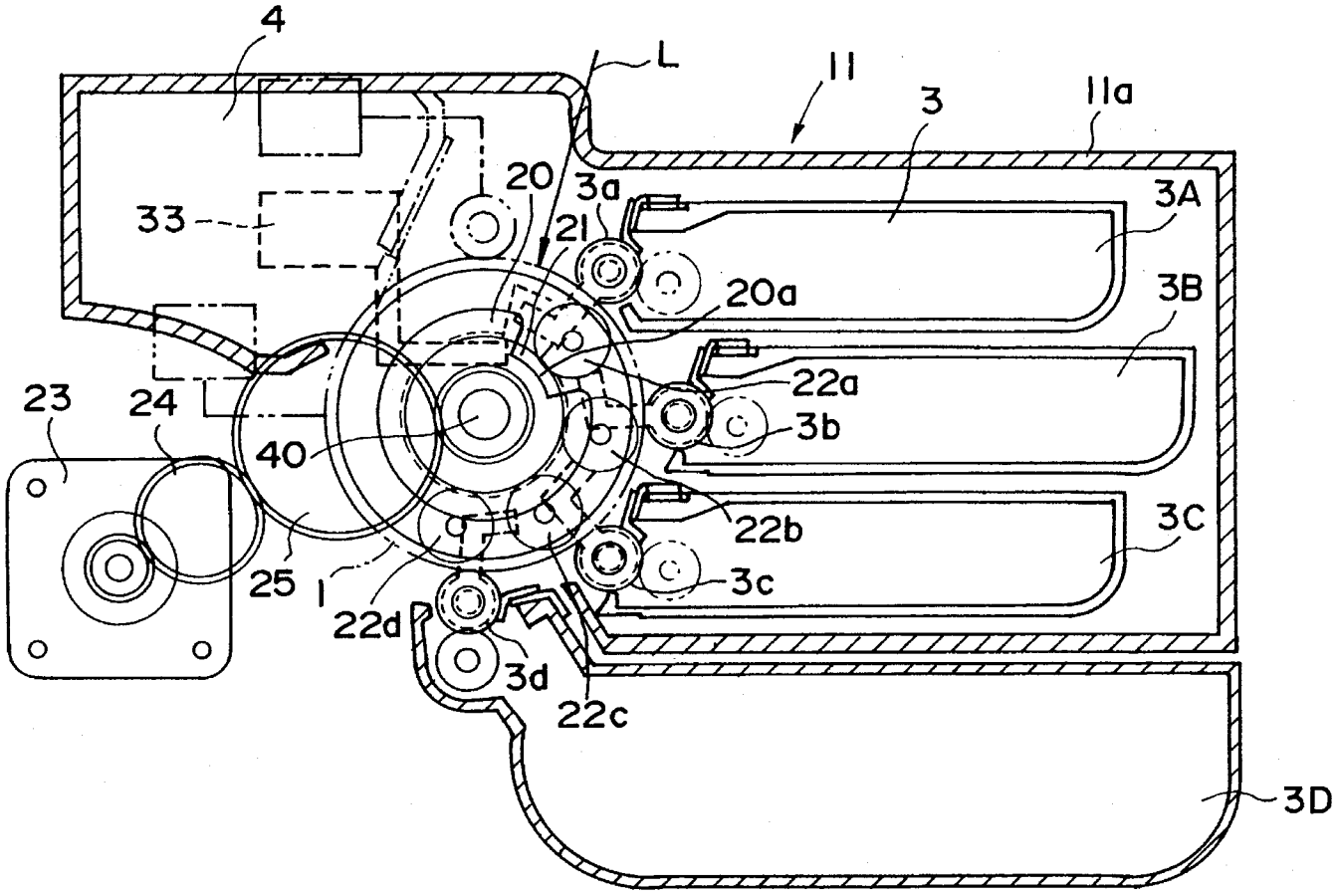
FIG. 6 is a side view of contact selecting means according to a fourth embodiment of the present invention.
Figure 7:
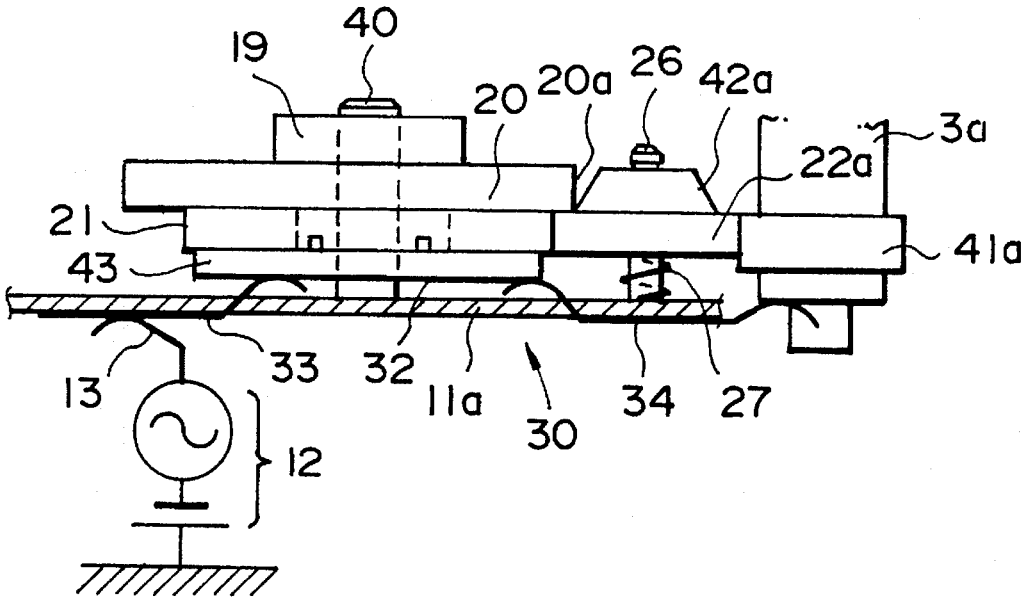
FIG. 7 shows electric connection between the developing sleeve and a voltage source in the fourth embodiment of the present invention.
Figure 8:
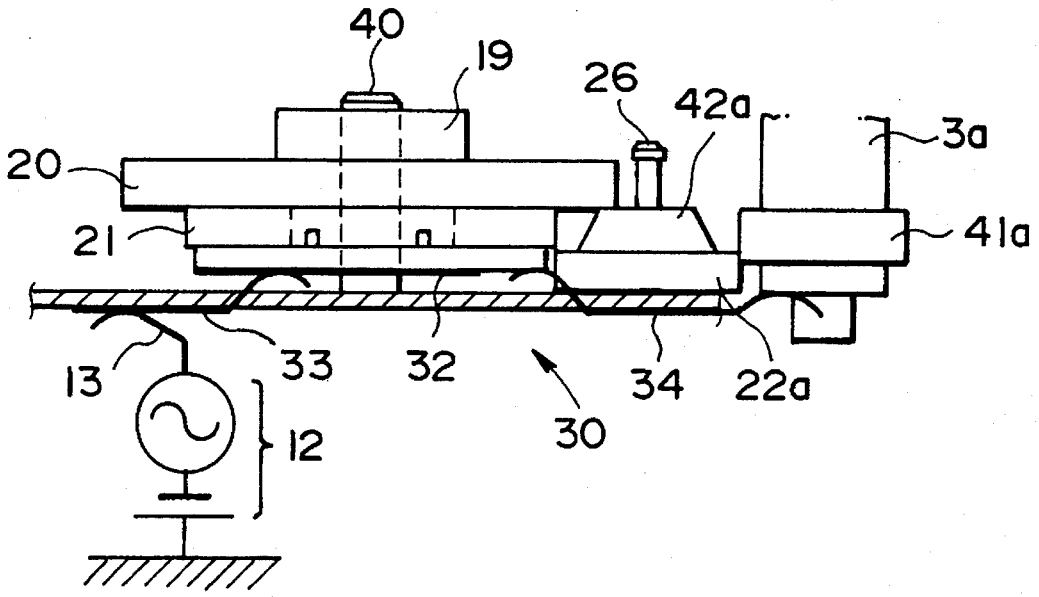
FIG. 8 shows electric disconnection between the developing sleeve and the voltage source.

Referring to FIGS. 6, 7 and 8, a fourth embodiment of the present invention will be described. In these Figures, the same reference numerals as in the foregoing embodiments are assigned to the elements having the corresponding functions, and the detailed description thereof is omitted for simplicity.

In this embodiment, a rotational driving force is selectively transmitted from the main assembly 100 to a selected developing device in the process cartridge 11, by the use of a driving device transmission switching mechanism, and a power supply contact switching mechanism 30 is provided in the process cartridge 11 of the image forming apparatus.

The driving force transmission switching mechanism will first be described. It comprises a cam driving gear 19, a transmission gear 21, shift gears 22*a*, 22*b*, 22*c*, and 22*d*, a motor 23 and first and second idler gears 24 and 25. The cam driving gear 19 is rotatably supported on a shaft 40 of the cartridge body 11*a* adjacent an end of the photosensitive drum 1. The transmission gear 21 is rotatably supported in a recess 20*a* of the cam member 20 and functions to transmit the rotational force from the main assembly 100 to the developing device. The shift gears 22*a*, 22*b*, 22*c*, and 22*d* are disposed between the drive transmission gear 21 and sleeve gears 41*a*, 41*b*, 41*c*, and 41*d* for rotation of the developing sleeves 3*a*, 3*b*, 3*c* and 3*d* of the developing devices and function to transmit the rotation of the transmission gear 21 to the developing devices. The motor 23 for rotating the cam driving gear 19 is provided in the main assembly 100.

The shift gear is supported on a shaft 22 of the cartridge body 11*a* for rotation and sliding movement in the axial direction. As shown in FIG. 6, it is normally urged to a position where it is meshed with the transmission gear 21, by a spring member 27. Since the projections 42*a*, 42*b*, 42*c*, and 42*d* of the shift gear 22 are urged by the cam member 20, and therefore, the shift gears which are not necessitated, are disposed at positions where the meshing engagement with the transmission gear 21 is released, as shown in FIG. 8. The shift gear and the sleeve gear are normally meshed with each other.

When a process cartridge 11 including the photosensitive drum 1, the charging roller 2, the yellow, magenta and cyan developing devices 3A, 3B, and 3C and the cleaning device 4 or the like, is mounted in the main assembly 100, the transmission gear 21 is brought into meshing engagement with an unshown driving gear of the main assembly, and the cam driving gear is meshed with the second idler gear 25 in the main assembly 100. Then, the process cartridge 11 is in the condition for image forming operation. When the image forming operation is started and thereafter a desired developing device 3 is selected, the motor 23 rotates the cam member 20 through the first and second idler gears 24 and 25 and through the cam driving gear 19, so that the shift gear 22 of the selected developing device 3 falls in the cam slot 20*a* of the cam member 20. Therefore, the shift gear 22 released from the cam member 20 is moved by the spring member 27 into engagement with the transmission gear 21, by which the rotation of the transmission gear 21 is transmitted through the shift gear 22 to the sleeve gear, and therefore, the developing sleeve of the selected developing device is rotated.

The description will be made as to the power supply contact switching mechanism 30. The power supply contact switching mechanism 30 comprises a switching plate 34, a switching contact 32, a cartridge contact 33, and developing device contact 34. The switching plate 43 is rotatably supported on a pin or shaft 18 of the cartridge body 11*a*. The switching contact 32 is the same as that of the first embodiment in that it is mounted on a side surface of the switching plate 43, and includes an electrically conductive ring portion 32*a* and a projected portion 32*b* extended outwardly from the conductive portion 32*a*. The switching plate 43 is clamped to a side surface of the projected portion 20*a* of the cam member 20 so as to be rotated in interrelation with the cam driving gear 19.

When a developing device 3 is selected, and the cam driving gear 19 rotates to transmit the driving force to the selected developing device 3, the switching plate 43 also rotates so that the cam slot 20*a* of the cam member 20 is positioned correctly in relation to the shift gear 22 of the selected developing device 3. In addition, the projected portion 32*b* of the switching contact 32 of the switching plate 43 is electrically connected with the developing device contact 34 of the selected developing device 3. In this manner, the bias voltage is supplied from the bias voltage source 12 to the developing sleeve of the selected developing device 3 through the cartridge contact 33 electrically connected with the main assembly contact 13 of the main assembly 100. Thus, the same effects as in the first embodiment are provided.

In the foregoing embodiments, the electric connection problems have been dealt with when the process cartridge including at least the image bearing member and the plural developing means is mounted to or demounted from the main assembly of the image forming apparatus. More particularly, a selecting means is provided to select one of first electric contacts of the plural developing means, and the electric connection is established between the selected first electric contact and the third electric contact, by which the electric connection is established at one point between the main assembly and any one of the plural developing means in the cartridge.

In the foregoing embodiment, however, there is an additional structure in which, to the cartridge 11 having the image bearing member and the developing means, a developing unit 3D (another developing means) is detachably mountable. The electric connection between the developing unit 3D and the cartridge 11 is completed simply by correctly positioning the developing sleeve 3*d* of the developing unit 3D relative to the image bearing member 1 in the cartridge 11. In addition, the electric connection between the unit 3D and the main assembly 100, is also completed thereby.

In the following embodiment, the electric connection between the developing unit and the cartridge and the electric connection between the developing unit and the main assembly are completed simply by correctly positioning the developing unit and the cartridge. As contrasted to the first–fourth embodiments, no selecting means for selecting one of the first electric contacts of the plural developing devices is not used, but it is further preferable if such a selecting means is used.

Figure 9:
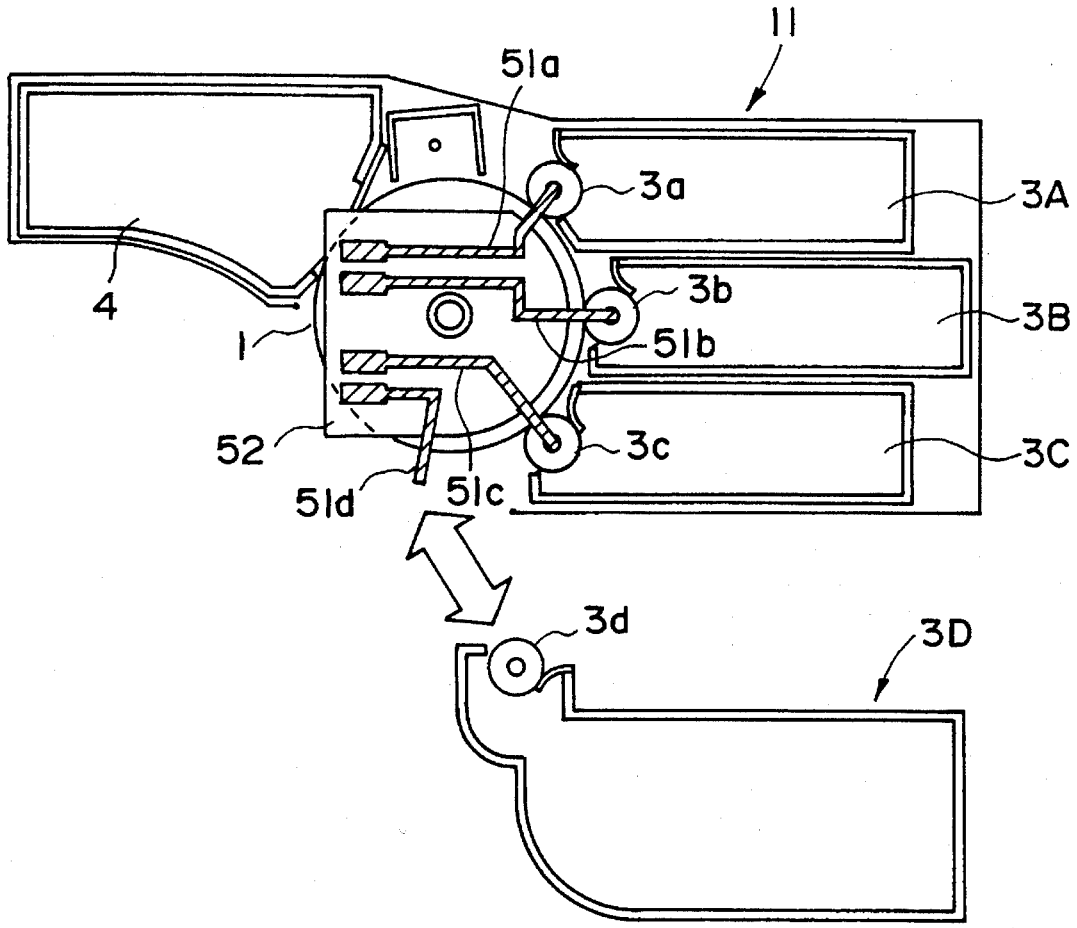
FIG. 9 is a side view of a process cartridge according to a fifth embodiment of the present invention.
Figure 10:
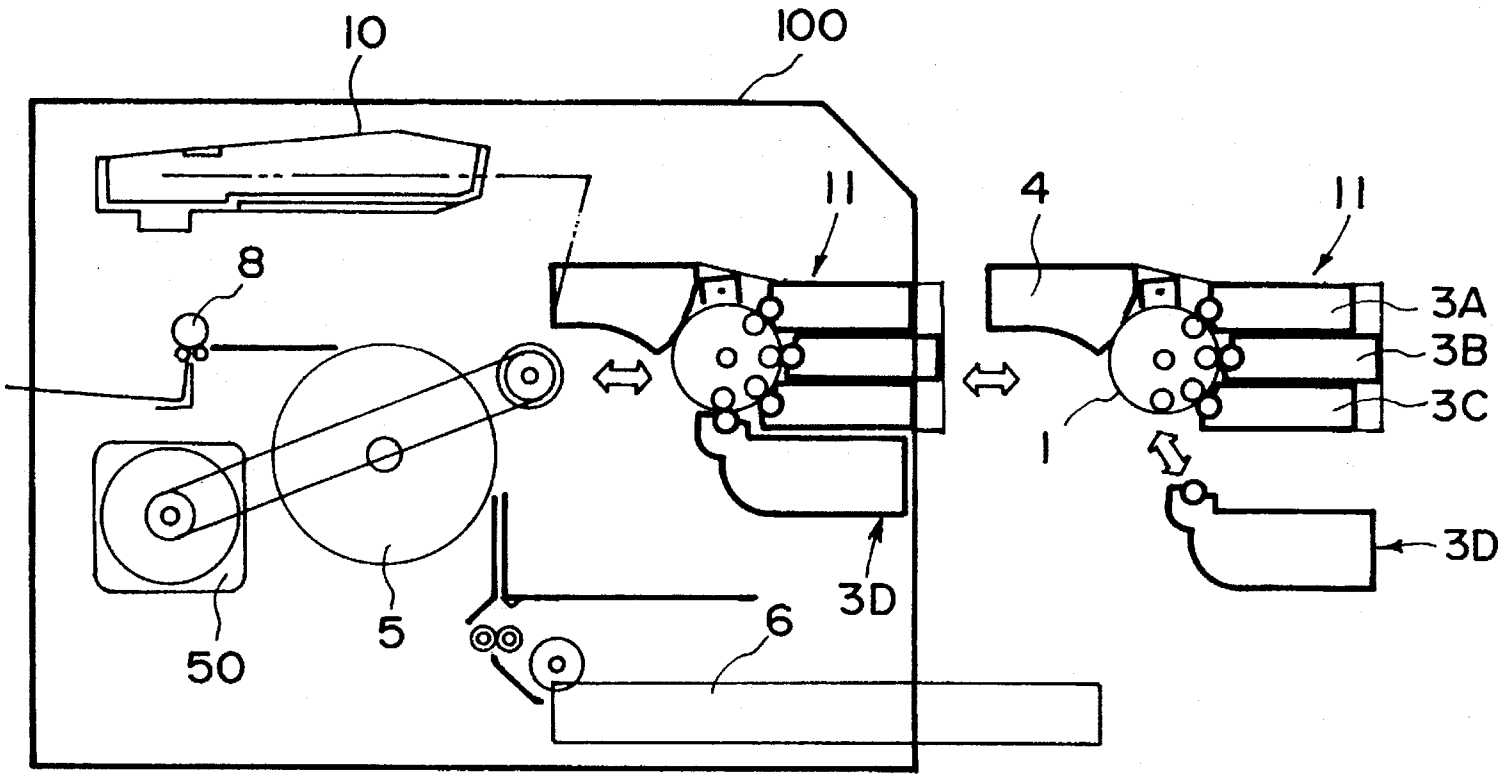
FIGS. 10 and 11 show an image forming apparatus to which the process cartridge is being mounted.
Figure 11:
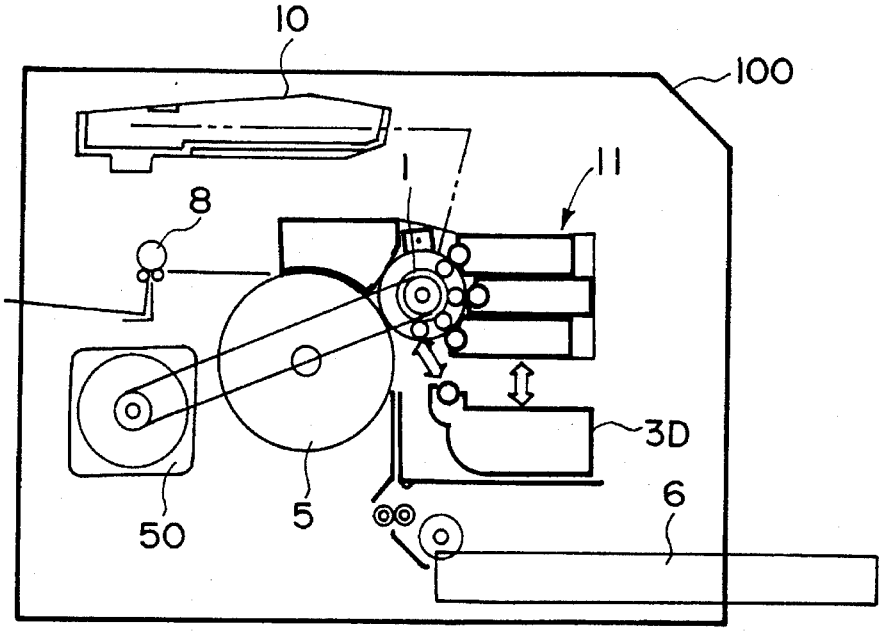

FIG. 9 is sectional views of the process cartridge and the developing unit of a multi-color image forming apparatus according to a fifth embodiment of the present invention. FIGS. 10 and 11 are sectional views of the multi-color image forming apparatus.

Referring first to FIGS. 10 and 11, the general arrangement of the multi-color image forming apparatus will be described. To the main assembly 100, the cartridge 11 and the developing unit 3D are detachably mountable. The cartridge 11 integrally includes an image bearing member 1, a plurality of developing devices 3A, 3B, and 3C and a cleaner unit 4 or the like. They are correctly positioned relative to the main assembly 100 of the apparatus on the basis of the image bearing member 1. The developing unit 3D, in effect, a developing device. As shown in FIG. 10, it is mounted to or demounted to the cartridge 11 in the direction of the arrow. The developing unit 3D may be mounted to or demounted from the main assembly 100 integrally with the cartridge 11 to which the developing unit 3D is mounted, or it may be mounted to or demounted from the cartridge 11 which is mounted in the main assembly 100, separately from the cartridge 11. Further alternatively, the cartridge may be mounted to the main assembly 100 after the developing unit is first mounted in the main assembly 100.

The main assembly 100 comprises a sheet feeding unit 16, a transfer member 5 for carrying the fed recording material, an optical unit 10, an image fixing unit 8 and a driving motor 50 for operating the transfer member 5.

As shown in FIG. 9, the developing devices 3A, 3B, and 3C in the cartridge 11 are provided with respective developer carrying members 3*a*, 3*b*, and 3*c*. To one longitudinal ends of the developer carrying members, electric contacts 51*a*, 51*b*, and 51*c* are contacted to apply the developing bias voltage. The contacts 51*a*, 51*b*, and 51*c* are fixed on a contact plate 52, which establishes electric contacts between the developer carrying member 3*a*, 3*b*, or 3*c* and a developing bias high voltage source unit (not shown) in the main assembly 100 by the contact with unshown contacts of the main assembly 100, when the cartridge 11 is mounted in the main assembly 100. When the developing bias is applied to the developer carrying member, the developer on the developer carrying member is supplied to the image bearing member 1 to develop the latent image thereon into a visualized or developed image.

To the contact plate 52, another electric contact 51*d* is fixed. When the developing unit 3D is mounted on the cartridge 11, the electric contact 51*d* is contacted to the developer carrying member 3 of the developing unit 3D to establish the electric connection between the high voltage source unit of the main assembly 100 and the developer carrying member 13*d*. When the developing bias voltage is applied from the high voltage source unit to the developer carrying member 3*d*, the developer on the developer carrying member 3*d* is supplied to the image bearing member 1 to develop the latent image thereon into a developed or visualized image.

As described in this embodiment, when the developing unit 3D is correctly positioned relative to the image bearing member 1 of the cartridge 11, the developing unit 3D is correctly positioned to establish the electric connection with the cartridge 11, automatically. Therefore, the need for an additional positioning mechanism for establishing the electric connection between the developing unit 3D and the main assembly 100, and the electric connection between the developing unit 3D and the main assembly 100 is still assured.

Figure 12:
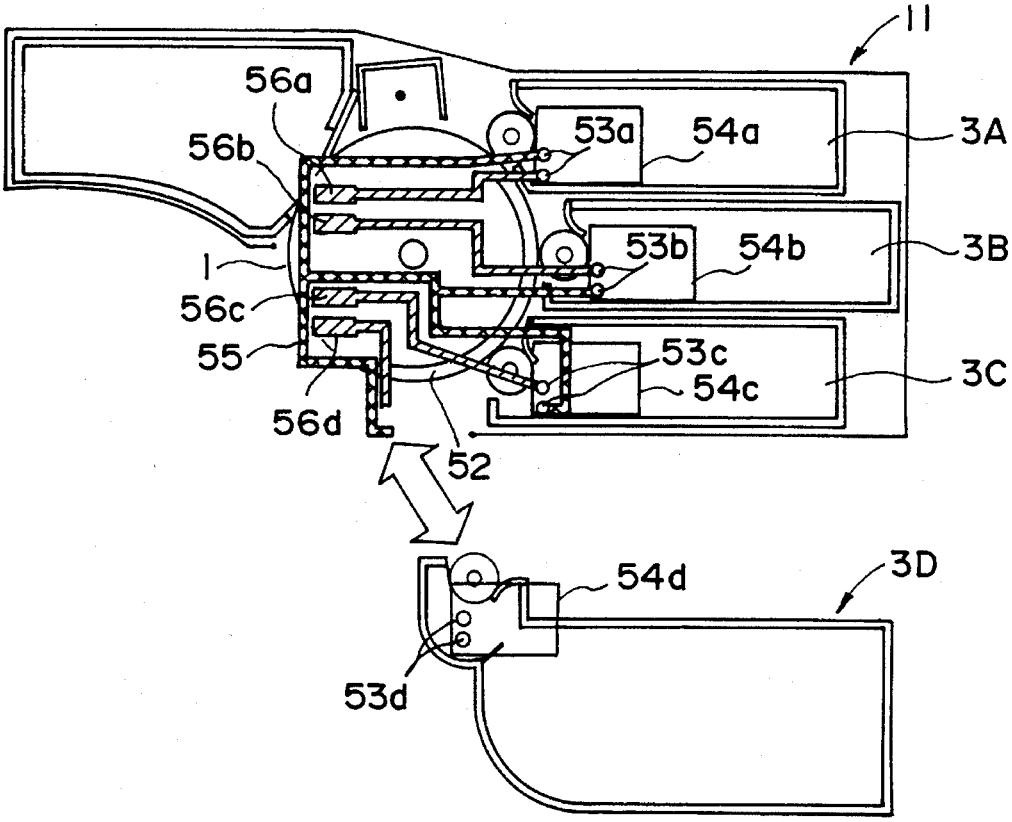
FIG. 12 is a cross-sectional side view of a process cartridge according to a sixth embodiment of the present invention.
Figure 13:
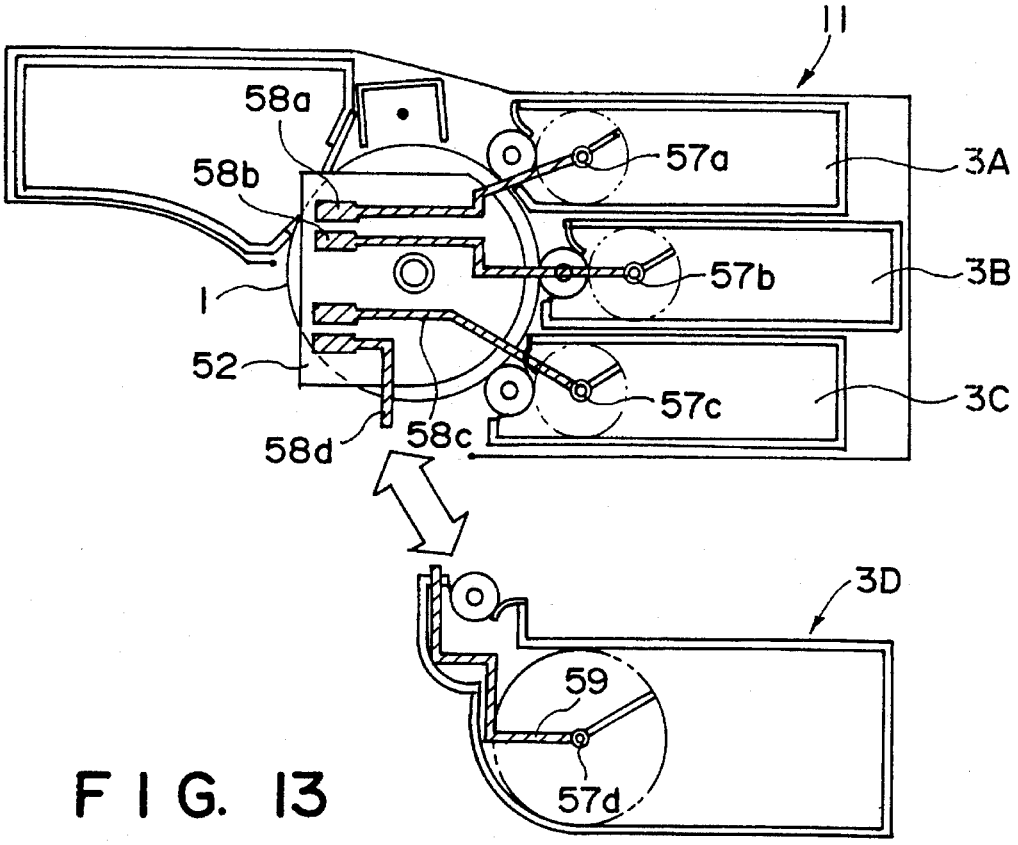
FIG. 13 is a cross-sectional view of a process cartridge according to a seventh embodiment of the present invention.
Figure 14:
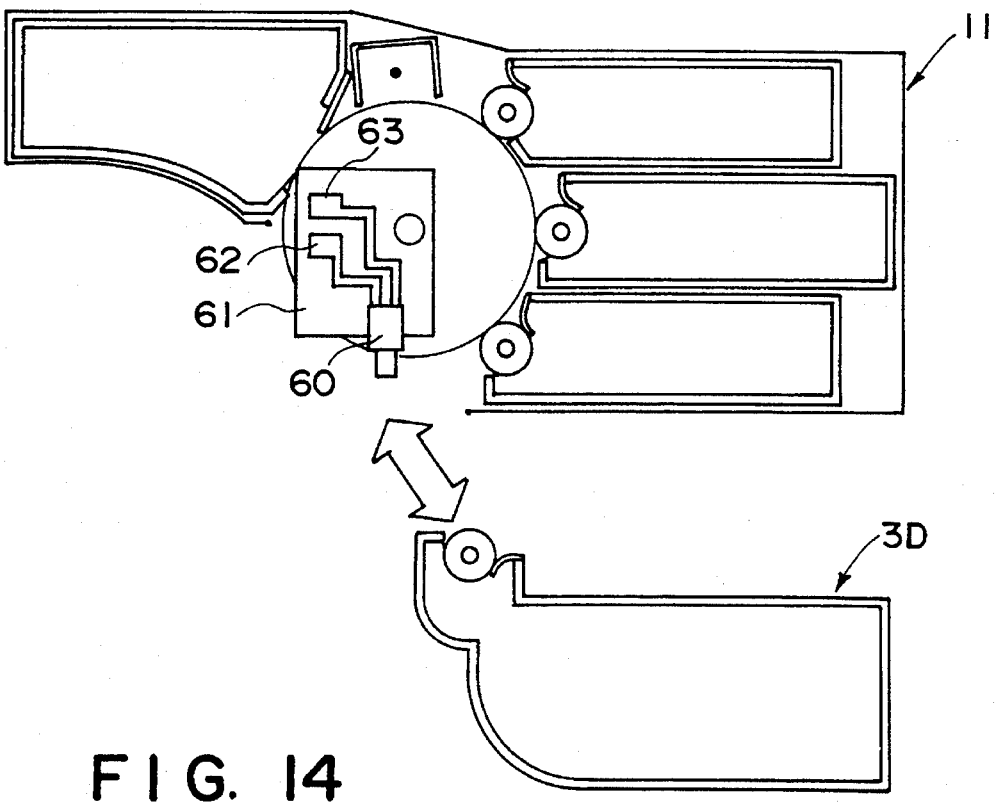
FIG. 14 is a cross-sectional view of a process cartridge according to an eighth embodiment of the present invention.

Referring to FIGS. 12, 13, and 14, a sixth, seventh, and eighth embodiments of the present invention will be described. These Figures are sectional views of main cartridges and subordinate cartridges. In these Figures, the same reference numerals as in FIG. 9 embodiment are assigned to the elements having the corresponding functions, and the detailed description thereof are omitted for simplicity.

In the sixth embodiment shown in FIG. 12, each of the developing devices 3A, 3B, 3C, and 3D is provided with an antenna member 53A, 53B, 53C, or 53D, respectively to detect the remaining amount of the developer. The antenna member comprises two shafts extended in parallel with an axis of the image bearing member 1, and the remaining amount of the developer is detected in accordance with a change in the electric capacity between the two shafts depending on the amount of the developer therebetween. To one of the two shafts constituting the antenna member, an AC voltage is applied, and to the other, a remaining amount detecting circuit board 54*a*, 54*b*, 54*c*, or 54*d* of the developing device 3A, 3B, 3C or 3D, respectively, is connected.

The cartridge 11 is provided with a contact plate 52, which is provided with contacts 55, 56*a*, 56*b*, 56*c*, and 56*d* mounted thereto. The contacts 55, 56*a*–56*d*, are contacted to unshown contacts of the main assembly 100, when the cartridge 11 is mounted to the main assembly 100 as shown in FIG. 10. Then, the contact 55 is contacted to an AC source of the main assembly 100, and the contacts 56*a*–56*d* are contacted to the CPU (not shown) of the main assembly 100 to permit the remaining amount detection signals from the circuit 54*a*–54*d* to the CPU.

When the developing unit 3D is mounted on the cartridge 11, the antenna member 53 is contacted to the contacts 55 and 56*d* of the cartridge 11, and is electrically connected with the main assembly 100 through the cartridge 11.

Thus, simply by correctly positioning the developing sleeve in the developing unit 3D relative to the image bearing member 1 in the cartridge 11, the electric connection is established between the developing unit and the cartridge. Simply by electrically connecting the cartridge and the main assembly, the toner remaining amount detecting function is enabled.

Since there is no need of direct electric connection between the developing unit and the main assembly, and therefore, the positioning accuracy between the developing unit and the main assembly and the operativity of the developing unit, are improved.

In the seventh embodiment shown in FIG. 13, the developing devices 3A, 3B, 3C, and 3D are provided with developer stirring members 57*a*, 57*b*, 57*c*, and 57*d*. In order to electrically ground the stirring members, contacts 58*a*, 58*b*, 58*c*, and 58*d* are contacted to longitudinal end portions of the stirring members.

The contacts 58*a*–58*d* are mounted on a contact plate 52 in the cartridge 11. When the cartridge 11 is mounted in the main assembly 100 shown in FIG. 10, the contacts 58*a*–58*d* are connected to an unshown grounded line of the main assembly 100.

To the stirring member 57*d* of the developing unit 3D, a contact 59 is contacted. When the developing unit 3D is mounted on the cartridge 11, the contact 59 is contacted to the contact 58*d* of the cartridge 11.

In the eighth shown in FIG. 14, the cartridge 11 is provided with a sensor 60 for detecting presence or absence of the developing unit 3D mounted thereon. When the developing unit 3D is mounted on the cartridge 11, the sensor 60 is pressed by the developing unit 3D so that the sensor 60 is actuated. The sensor 60 is mounted on the sensor member 61 fixed on the cartridge 11, and the signal line of the sensor 60 are contacted to the contacts 62 and 63 on the sensor member 61.

When the cartridge 11 is mounted on the main assembly 100 (FIG. 10), the contacts 62 and 63 are contacted to the main assembly 100, and the presence or absence of the developing unit 3D is detected at the main assembly 100 by way of the cartridge 11.

As described in the foregoing, according to the present invention, there is provided a selecting means or selecting one of first electric contacts of plural developing means in the cartridge, and the electric connection is established between the selected first contact and a third contact of the main assembly, one electric connection at one point is sufficient for the electric connection between the main assembly and the plural developing means in the cartridge. Therefore, the improper electric connection between the cartridge and the main assembly can be reduced, and the operativity of the cartridge is improved.

According to another aspect of the present invention, the electric connection between the developing unit and the cartridge can be established simply by positioning the developing sleeve in the developing unit relative to the image bearing member in the cartridge having the image bearing member and the developing means, and therefore, the direct electric connection between the developing unit and the main assembly, is not required. Therefore, the operativity of the developing unit is improved, and the positioning accuracy is also improved.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus, said process cartridge comprising:

a photosensitive member;

first developing means for developing a latent image formed on said photosensitive member;

second developing means for developing, in a color different from that developed by said first developing means, a latent image formed on said photosensitive member;

a common electric contact for establishing an electric connection with an electric contact of the main assembly when said process cartridge is mounted to the main assembly;

a first electric contact, connected to said first developing means, for supplying a voltage to said first developing means;

a second electric contact, connected to said second developing means, for supplying a voltage to said second developing means; and selecting means, mounted coaxially with said photosensitive member, for selectively establishing by rotational contact an electric connection between said common electric contact and one of said first electric contact and said second electric contact.

2. A process cartridge according to claim 1, wherein each of said first developing means and said second developing means is capable of being supplied with a bias voltage through said common electric contact.

3. A process cartridge according to claim 1, wherein said selecting means comprises a switching member driven by the image forming apparatus to electrically connect a selected one of said first electric contact and said second electric contact.

4. A process cartridge according to claim 1, wherein said first developing means and said second developing means contain different color developers, respectively.

5. A process cartridge according to claim 4, wherein said color developers include yellow, magenta, and cyan developers.

6. A process cartridge according to claim 4, wherein said selecting means is operable in accordance with a color of the developer to be supplied to said photosensitive member.

7. A process cartridge according to claim 1, further comprising charging means for uniformly charging said photosensitive member and cleaning means for removing residual matter from said photosensitive member.

8. An image forming apparatus having a main assembly to which a process cartridge is detachably mountable, said image forming apparatus comprising:

a mounting portion for mounting to said image forming apparatus a process cartridge that includes a photosensitive member; first developing means for developing a latent image formed on the photosensitive member; second developing means for developing, in a color different from that developed by the first developing means, a latent image formed on the photosensitive member; a common electric contact for establishing an electric connection with an electric contact of the main assembly when the process cartridge is mounted to the main assembly; a first electric contact, connected to the first developing means, for supplying a voltage to the first developing means; a second electric contact, connected to the second developing means, for supplying a voltage to the second developing means; and selecting means, mounted coaxially with the photosensitive member, for selectively establishing by rotational contact an electric connection between the common electric contact and one of the first electric contact and the second electric contact;

a main assembly contact for establishing an electric connection with the common electric contact of the process cartridge when the process cartridge is mounted to said mounting portion; and a voltage source connected to said main assembly contact.

9. An image forming apparatus according to claim 8, wherein said voltage source applies a bias voltage to the first developing means and the second developing means.

10. An image forming apparatus according to claim 8, wherein the selecting means includes a switching member for establishing an electric connection between the common electric contact and a selected one of the first electric contact and the second electric contact.

11. An image forming apparatus according to claim 10, further comprising driving means for engaging with and driving the switching member when the process cartridge is mounted to said image forming apparatus.

12. An image forming apparatus according to claim 8, wherein the first developing means and the second developing means contain different color developers.

13. An image forming apparatus according to claim 12, wherein the color developers include yellow, magenta, and cyan developers.

14. An image forming apparatus according to claim 12, wherein said image forming apparatus is capable of forming a full-color image.

15. An image forming apparatus according to claim 12, wherein the selecting means is operable in accordance with a color of the developer to be supplied to the photosensitive member.

16. A process cartridge detachably mountable to a main assembly of an image forming apparatus, said process cartridge comprising:

a photosensitive member;

a first developer including a first developing roller disposed adjacent to said photosensitive member to develop in a first color a latent image formed on said photosensitive member;

a second developer including a second developing roller disposed adjacent to said photosensitive member to develop, in a second color different from said first color, a latent image formed on said photosensitive member;

a third developer including a third developing roller disposed adjacent to said photosensitive member to develop, in a third color different from said first and second colors, a latent image formed on said photosensitive member;

a first electric contact, connected to said first developer, for supplying a voltage to said first developer;

a second electric contact, connected to said second developer, for supplying a voltage to said second developer;

a third electric contact, connected to said third developer, for supplying a voltage to said third developer;

a movable common electric contact for establishing an electric connection between one of said first, second, and third electric contacts and an electric contact of the main assembly when said process cartridge is mounted to the main assembly; and a selector, mounted coaxially with said photosensitive member, for selecting one of said first, second, and third electric contacts to establish by rotational contact an electric connection between said common electric contact and said selected electric contact.

17. A process cartridge according to claim 16, wherein each of said first developer, said second developer, and said third developer is capable of being supplied with a bias voltage through said common electric contact.

18. A process cartridge according to claim 16, wherein said selector comprises a switching member driven by the image forming apparatus to electrically connect a selected one of said first electric contact, said second electric contact, and said third electric contact.

19. A process cartridge according to claim 16, wherein said first developer, said second developer, and said third developer contain different color developer materials, respectively.

20. A process cartridge according to claim 19, wherein said color developer materials include yellow, magenta, and cyan developer materials.

21. A process cartridge according to claim 19, wherein said selector is operable in accordance with a color of the developer material to be supplied to said photosensitive member.

22. A process cartridge according to claim 16, further comprising a charger that uniformly charges said photosensitive member and a cleaner that removes residual matter from said photosensitive member.

23. A process cartridge according to claim 16, wherein said process cartridge is usable with a fourth developer that is detachably mountable to the main assembly independently of the mounting of said process cartridge, wherein the fourth developer develops the latent image formed on said photosensitive member with a black developer material.

24. An image forming apparatus having a main assembly to which a process cartridge is detachably mountable, said image forming apparatus comprising:

a mounting portion for mounting to said image forming apparatus a process cartridge that includes a photosensitive member; a first developer including a first developing roller disposed adjacent to the photosensitive member to develop a latent image formed on the photosensitive member; a second developer including a second developing roller disposed adjacent to the photosensitive member to develop, in a second color different from the first color, a latent image formed on the photosensitive member; a third developer including a third developing roller disposed adjacent to the photosensitive member to develop, in a third color different from the first and second colors, a latent image formed on the photosensitive member; a first electric contact, connected to the first developer, for supplying a voltage to the first developer; a second electric contact, connected to the second developer, for supplying a voltage to the second developer; a third electric contact, connected to the third developer, for supplying a voltage to the third developer; a movable common electric contact for establishing an electric connection between one of the first, second, and third electric contacts and an electric contact of said main assembly when the process cartridge is mounted to said main assembly; and a selector, mounted coaxially with said photosensitive member, for selecting one of the first, second, and third electric contacts to establish by rotational contact an electric connection between the common electric contact and the selected electric contact;

a main assembly contact for establishing an electric connection with the common electric contact of the process cartridge when the process cartridge is mounted to said mounting portion; and a voltage source connected to said main assembly contact.

25. An image forming apparatus according to claim 24, wherein said voltage source applies a bias voltage to the first developer, the second developer, and the third developer.

26. An image forming apparatus according to claim 24, wherein the selector includes a switching member that establishes an electric connection between the common electric contact and a selected one of the first electric contact, the second electric contact, and the third electric contact.

27. An image forming apparatus according to claim 26, further comprising a driver that engages with and drives the switching member when the process cartridge is mounted to said image forming apparatus.

28. An image forming apparatus according to claim 24, wherein the first developer, the second developer, and the third developer contain different color developer materials, respectively.

29. An image forming apparatus according to claim 28, wherein the color developer materials include yellow, magenta, and cyan developer materials.

30. An image forming apparatus according to claim 28, wherein said image forming apparatus is capable of forming a full-color image.

31. An image forming apparatus according to claim 28, wherein the selector is operable in accordance with a color of the developer material to be supplied to the photosensitive member.

32. An image forming apparatus according to claim 24, wherein the process cartridge is usable with a fourth developer that is detachably mountable to said main assembly independently of the mounting of the process cartridge, wherein the fourth developer develops the latent image formed on the photosensitive member with a black developer material.

* * * * *

UNITED STATES PATENT AND TRADEMARK OFFICE

CERTIFICATE OF CORRECTION

PATENT NO. : 5,521,693

DATED : May 28, 1996

INVENTOR(S) : HISAYOSHI KOJIMA, ET AL.

It is certified that error appears in the above-indentified patent and that said Letters Patent is hereby corrected as shown below:

ON THE COVER PAGE

[56] ABSTRACT

Line 9, "connecting" should read --connect--.

COLUMN 1

Line 25, "the" should be deleted;
Line 26, "is" should read --be--; and
Line 39, "case" should read --case of--.

COLUMN 2

Line 36, "a" should be deleted.

COLUMN 3

Line 14, "of" should read --of the--;
Line 36, "are formed" should be deleted;
Line 38, "chain" should read --cyan--; and
Line 50, "fused, and mixed" should read --fused, mixed,--.

COLUMN 4

Line 27, "from" should read --from the--; and
Line 35, "One side ends" should read --One of each of the side ends--.

UNITED STATES PATENT AND TRADEMARK OFFICE

CERTIFICATE OF CORRECTION

PATENT NO. : 5,521,693 Page 2 of 3

DATED : May 28, 1996

INVENTOR(S) : HISAYOSHI KOJIMA, ET AL.

It is certified that error appears in the above-indentified patent and that said Letters Patent is hereby corrected as shown below:

COLUMN 5

Line 20, "The" should read --With the--;
Line 26, "element" should read --elements--;
Line 27, "are" should read --is--; and
Line 56, "as" should be deleted.

COLUMN 6

Line 21, "is" should read --are--; and
Line 30, "the" should read --a--.

COLUMN 7

Line 54, "of" should read --of the--.

COLUMN 8

Line 12, "not" should be deleted;
Line 28, "3D," should read --3D is,--;
Line 29, "to" (second occurrence) should read --from--; and
Line 44, "one longitudinal" should read --one of each of the longitudinal--.

UNITED STATES PATENT AND TRADEMARK OFFICE

CERTIFICATE OF CORRECTION

PATENT NO. : 5,521,693

DATED : May 28, 1996

INVENTOR(S) : HISAYOSHI KOJIMA, ET AL.

It is certified that error appears in the above-indentified patent and that said Letters Patent is hereby corrected as shown below:

COLUMN 9

Line 14, "a" should be deleted;
Line 18, "in" should read --in the--; and
Line 20, "the" should read --a--, and "are" should read --is--.

COLUMN 10

Line 10, "eighth" should read --eighth embodiment--;
Line 17, "are" should read --is--;
Line 25, "or" should read --for--; and
Line 29, "is" should read --being--.

Signed and Sealed this

Twenty-fourth Day of December, 1996

Bruce Lehman

*Attest:*

BRUCE LEHMAN

*Attesting Officer*

*Commissioner of Patents and Trademarks*